United States Patent [19]

Stitz

[11] Patent Number: 4,685,637

[45] Date of Patent: Aug. 11, 1987

[54] YARN TRAVERSING GUIDE

[75] Inventor: Albert Stitz, Kürten, Fed. Rep. of Germany

[73] Assignee: Barmag AG, Remscheid, Fed. Rep. of Germany

[21] Appl. No.: 902,305

[22] Filed: Aug. 29, 1986

[30] Foreign Application Priority Data

Aug. 29, 1985 [DE] Fed. Rep. of Germany ..... 3530804

[51] Int. Cl.[4] ..... B65H 54/30

[52] U.S. Cl. ..... 242/157 R; 242/43 R; 242/158.3

[58] Field of Search ..... 242/43 R, 158.3, 158.5, 242/157 R

[56] References Cited

U.S. PATENT DOCUMENTS

| | | | |
|---|---|---|---|
| 3,059,874 | 10/1962 | Hays | 242/158.3 X |
| 3,664,596 | 5/1972 | Lenk | 242/43 R |
| 3,934,831 | 1/1976 | Bruggisser et al. | 242/43 R |
| 4,116,396 | 9/1978 | Fluck | 242/43 R |

*Primary Examiner*—Stanley N. Gilreath

*Attorney, Agent, or Firm*—Bell, Seltzer, Park & Gibson

[57] ABSTRACT

A traversing yarn guide is disclosed which is adapted for reciprocating an advancing yarn or the like to form a wound package on a yarn winding machine of the type which includes a drive roll having a cross spiraled groove, and an adjacent pair of guide rails. The yarn guide includes a body member composed of an elongate follower which is adapted to be received in the groove of the cross spiraled drive roll, and two pairs of guide arms which extend laterally outwardly from the follower, and which have outer edges defining a generally diamond shaped outline in plan view. The yarn guide further includes a yarn engaging member having a slot for receiving and guiding the advancing yarn, and the arms of the body member are composed of a relatively resilient material which provides flexibility to the arms and which has been found to reduce abrasion and fatigue damage and thereby increase the service life of the guide.

12 Claims, 8 Drawing Figures

YARN TRAVERSING GUIDE

BACKGROUND OF THE INVENTION

The present invention relates to a traversing yarn guide adapted for reciprocating an advancing yarn or the like to form a wound package on a yarn winding machine.

Conventional yarn winding machines include a yarn package mounting spindle, a drive for rotating the spindle and package, and an adjacent traversing system for traversing the yarn as it advances onto the package. The traversing system includes a drive roll having a cross spiraled groove, and an adjacent pair of guide rails having a slot therebetween which extends parallel to the axis of the drive roll. Also, a yarn guide is provided which includes a follower positioned in the groove of the drive roll and a yarn engaging member which extends through the slot of the guide rails and such that the rotation of the drive roll causes the yarn guide to reciprocate back and forth along the slot between the guide rails. A system of this general type is disclosed in U.S. Pat. No. 3,664,596 to Lenk.

The yarn guide as disclosed in the above Lenk patent includes a plate like member positioned between the follower and the yarn engaging member, and the plate like member has a generally diamond shaped outline in plan view, so as to define opposite pairs of parallel guide edges which are designed to alternately engage opposing groove walls on the guide rails as the yarn guide reciprocates. Specifically, one pair of parallel guide edges engages the opposing walls of the guide rails as the guide moves in one direction, and the opposite pair of parallel guide edges engages the opposing walls during movement in the opposite direction. In the reversal areas, wherein the cross spiraled groove reverses its pitch, the yarn guide pivots about an axis which is perpendicular to the drive roll to effect its alternative orientation with respect to the guide rails.

As also disclosed in the above Lenk patent, the guide rails enclose the plate like member of the yarn guide on both the front and rear sides, so that the traversing guide is positively guided both in the axial direction along the slot, as well as in the two directions which are perpendicular to the axis of the cross spiraled drive roll. A traversing yarn guide of the above described type has found widespread use in traversing systems for winding machines processing man-made yarns, and which operate at speeds above 1000 m/min.

As will be apparent, the traversing speed of the yarn guide depends upon the winding speed. In addition, the build of a proper cylindrical package necessitates the very rapid reversal of the yarn guide at the stroke ends. Stated otherwise, the cross spiraled groove of the drive roll should have a very small radius of curvature at the stroke reversal points. As a result, the traversing yarn guide is subjected to very high accelerations at each stroke end, and the service life of the guide is thus limited by the resulting abrasion and fatigue damage.

It is accordingly an object of the present invention to provide a traversing yarn guide of the described type, and which has improved service life.

Prior attempts to improve the service life have involved attempts to minimize the weight of the guide, and the selection of optimum materials. Also, relatively large radii of curvature of the cross spiraled groove have been accepted at the stroke reversal points, which are not totally satisfactory from the viewpoint of winding technology and package build.

SUMMARY OF THE INVENTION

The present invention diverges from these prior efforts, and the above objects and advantages have been achieved by the provision of a yarn guide which comprises a body member composed of an elongate follower defining a longitudinal plane, and first and second arms mounted on one side of the follower. The arms extend laterally outwardly in opposite directions from the longitudinal plane and are in substantial lateral alignment. The arms have relatively straight outer edges which present a somewhat V-shaped outline in plan view and have an obtuse angle therebetween. Also, the arms are composed of a relatively resilient material, whereby the arms are relatively flexible. The yarn guide further includes a yarn engaging member mounted to the body member and including a portion which extends beyond the side of the arms opposite the follower.

In a preferred embodiment, the body member includes two pairs of arms, with the two arms of each pair extending laterally outwardly in opposite directions from the longitudinal plane. Also, the arms have outer edges which collectively define a generally diamond-shaped outline in plan view, and here again, the arms are composed of a relatively resilient material whereby the arms are relatively flexible.

In accordance with the present invention, the outer edges of the arms not only serve to guide the movement of the yarn guide along the slot between the guide rails of the traversing system, but they also provide a further function in that the flexibility of the arms serves to compensate and dampen non-uniformities of the motion to which the traversing yarn guide is subjected, and which are caused by inherent oscillations and difficulties in achieving a straight line guidance, as well as the accelerations encountered at the reversal points. In this regard, preliminary test samples of the present invention have resulted in an improvement of service life by more than 30 percent over the designs of the prior art.

An important feature of the present invention is the fact that the guide edges of the yarn guide are defined by outwardly extending guide arms, which are resiliently joined to the remainder of the yarn guide. The arms are firmly joined to the remainder of the yarn guide along the longitudinal plane defined by the follower, and the arms are designed so as to be relatively thin. Preferably, four guide arms are provided, which are disposed in two pairs of laterally aligned arms, and each of the arms have one end resiliently connected with the remainder of the guide at their inner ends, and so that the aligned arms of each pair define an obtuse angle along their outer edges. At their outer ends, the guide arms on each side of the longitudinal plane define acute angles, and they are relatively movable. An appropriate selection of the material of the arms permits the arms to also provide good damping properties.

In one embodiment of the invention, the guide arms are attached to the remainder of the yarn guide in cantilever fashion, and the arms are resiliently movable in a manner similar to a spring bar held at one end. However, to obtain adequate strength and resistance to fatigue, it is desirable to make the arms relatively thick at their mounting ends. In another embodiment, relatively thick mounting ends are not required, and the arms are joined to each other at their outer ends. As a result, each arm contributes to the strength of its joined arm.

In the preferred embodiment, the body member of the yarn guide includes a central bar which extends laterally between the pairs of arms and generally perpendicular to the longitudinal plane defined by the follower. The central bar serves for mounting the yarn engaging member, which is composed of a wear resistant material. The central bar is located within the diamond-shaped outline defined by the pairs of arms, and is located along the longest diagonal of the diamond-shaped outline. Also, for mounting purposes, the yarn engaging member may be inserted in a slot on the central bar.

The above embodiment makes it possible to further support the outer ends of the arms by means of the central bar. In particular, the central bar is also designed and constructed as a flexible resilient arm, and each of its ends may be joined to the outer ends of the adjacent two arms to thereby provide increased strength and resistance to the alternating stresses applied to the arms.

When the ends of the arms are connected to each other, and possibly also to the end of the central bar, the interconnections may be made particularly resilient and soft, so as to maintain the flexibility of the arms.

There are several possibilities for mounting the arms to the remaining portions of the yarn guide. In one embodiment, the arms are directly mounted on the upper side of the follower, and in this case, the underside of the arms, as well as the underside of the central bar if present, are designed so as to be suited for sliding contact with the circumference of the cross spiraled roll. Also, the guide rails which serve to guide the yarn guide in straight line movement, may have an L-shaped cross section, rather than a U-shaped cross section as is the case with the apparatus disclosed in the above Lenk patent. The straight line guidance and positioning of the traversing yarn guide is thus controlled by the opposing groove walls on the guide rails and which extend parallel to each other. In the lateral direction, i.e. a radial direction with respect to the cross spiraled drive roll, the traversing yarn guide is maintained in position on the side opposite the drive roll by the L-shaped guide rail, and on the opposite side by the drive roll itself.

In another embodiment, the arms of the yarn guide may be mounted directly to projecting connecting segments, with these connecting segments being mounted to the upper side of the follower and substantially in the longitudinal plane, i.e. along the short diagonal of the diamond-shaped outline defined by the outer edges of the arms.

In another embodiment, the connecting bars are mounted directly to the central bar, approximately at its longitudinal center, and the connecting segments extend parallel to the follower between the central bar and the arms. This embodiment is particularly advantageous where the central bar, which carries the yarn engaging member, is connected with the follower across a narrow neck or post as illustrated in the Lenk patent.

Thus in accordance with the present invention, a very compact, small design with good stability and good spring and dampening properties, is provided when the guide arms are mounted on the follower and project laterally therefrom, and the central bar is centrally attached therebetween. As previously indicated, the follower may be connected to the central bar, connecting segments, and arms via a narrowed neck or post extending between the follower and central bar. However, an embodiment which has proven to be particularly suitable for optimizing the service life by reason of its compact design, is characterized in that there is no such narrowed neck or post, and the guide arms, central bar, and connecting segments if present, are all directly mounted on the upper side of the follower. In this latter case, the underside of the arms, central bar, and connecting segments are fully or partially designed as a sliding surface, which is designed to glide on the surface of the cross spiraled drive roll.

BRIEF DESCRIPTION OF THE DRAWINGS

Some of the objects and advantages having been stated, others will appear as the description proceeds, when taken in conjunction with the accompanying drawings, in which.

DETAILED DESCRIPTION OF THE PREFERRED EMBODIMENTS

Figure 1:
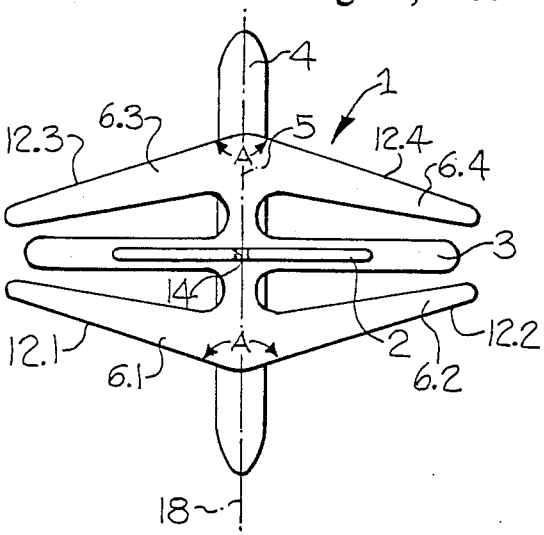
FIG. 1 is a top plan view of a traversing yarn guide which embodies the features of the present invention.

Referring more particularly to the drawings, FIG. 1 illustrates a traversing yarn guide 1 which comprises a body member which is composed of an elongate follower 4 which defines a longitudinal plane 18 which extends along the widthwise center of the follower. The follower has an arcuate curvature when viewed transversely to the longitudinal plane and as best seen for example in FIG. 2, so that the follower conforms to the curvature of a groove 8 in a drive roll 7. The body member also includes two pairs of arms mounted on the upper side of the follower 4, namely a first pair of arms 6.1 and 6.2, and a second pair of arms 6.3 and 6.4. The first pair of arms 6.1 and 6.2 extend laterally outwardly in opposite directions from the longitudinal plane and are in substantial lateral alignment. The other pair of arms 6.3 and 6.4 also extend laterally outwardly in opposite directions from the longitudinal plane. The arms of each pair have relatively straight outer edges 12.1-12.2 and 12.3-12.4, respectively, which define a somewhat V-shaped outline in plan view, and the outer edges of each pair of arms define an obtuse angle A therebetween. The outer edges 12.1 - 12.4 of the four arms also collectively define a generally diamond shaped outline in plan view, and as best seen in FIG. 1.

The body member of the yarn guide further includes a central bar 3 which extends laterally between the pairs of arms, and generally perpendicular to the longitudinal plane 18. The central bar is mounted to the follower 4, and a yarn engaging member 2 is mounted to the central bar of the body member so as to be positioned on the side of the central bar opposite the follower 4. The yarn engaging member 2 is in the form of a triangular plate which extends in a plane generally perpendicular to the longitudinal plane, and the triangular yarn engaging member includes a base edge mounted directly to the central bar and an opposite corner which extends outwardly beyond the side of the arms opposite the follower, and the opposite corner has a yarn receiving transverse slot 14 therein.

The body member further includes connecting segments 5 which are mounted on the upper side of the follower 4 and substantially along the longitudinal plane, and the connecting segments extend between the central bar and the base portion of the adjacent pair of arms.

The yarn engaging member 2 is preferably fabricated from a plate of wear resistant material, such as ceramic, and the remainder of the yarn guide including the follower 4, arms 6.1–6.4, and central bar 3 is composed of an integral piece of thermoplastic or thermosetting plastic.

As noted above, the follower 4 is an elongate member which is arcuately curved so that it is adapted to the radius of curvature of the thread groove 8 in a cross spiraled roll 7. Similarly, the follower 4 conforms to the thread groove 8 in its cross section and widthwise dimension, note particularly FIG. 3. As illustrated, the central bar 3 and the guide arms 6.1–6.4 are attached to the upper side of the follower 4, and the guide arms are connected via the connecting segments 5 with the central bar 3 along the longitudinal plane of the follower 4. The free ends of the guide arms 6.1–6.4 are adapted for a resilient and dampened movement, by reason of the properties of the plastic material of which they are formed.

Figure 2:
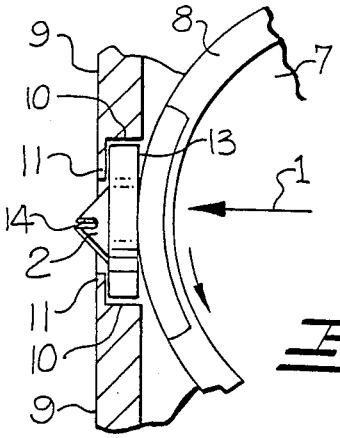
FIG. 2 is a fragmentary partially sectioned view of the yarn guide shown in FIG. 1, together with a portion of the associated drive roll and guide rails.

It should be noted that during a predetermined direction of rotation of the cross spiraled roll 7, only the guide arms on one side of the yarn guide are directly carried, i.e. the lower guide arms 6.1 and 6.2 as seen in FIGS. 1 and 2. The two other guide arms, i.e. the upper arms 6.3 and 6.4 as seen in FIGS. 1 and 2, generally serve to stabilize the yarn guide, and they may be omitted or replaced by a differently shaped guide member, the form of which permits the traversing yarn guide to perform a rotary movement at the ends of the traversing stroke about a pivoting axis which is in alignment with the slot 14 of the yarn engaging member.

Figure 3:
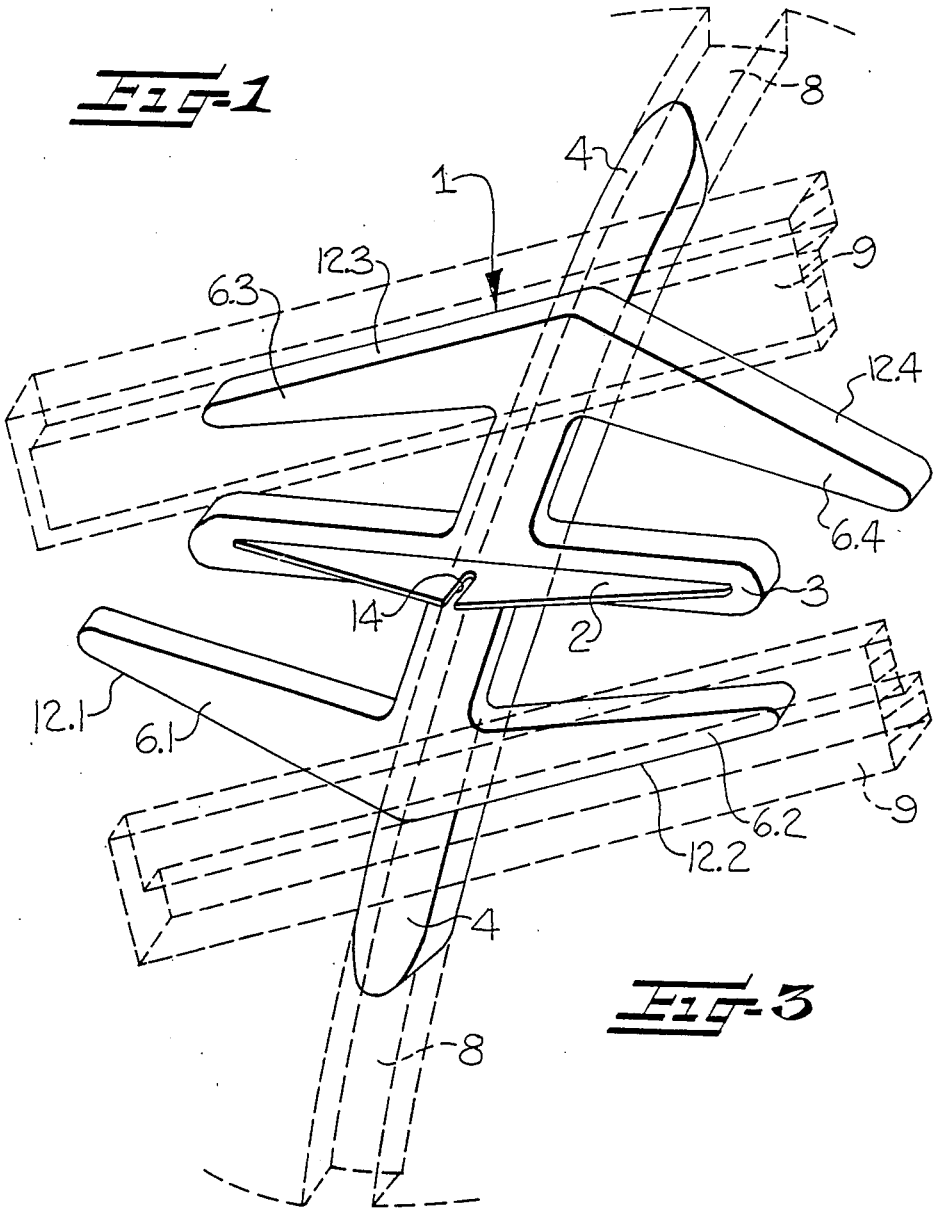
FIG. 3 is a perspective view of a yarn guide in accordance with the present invention, and which illustrates the groove of the drive roll and guide rails in dashed lines.
Figure 4:
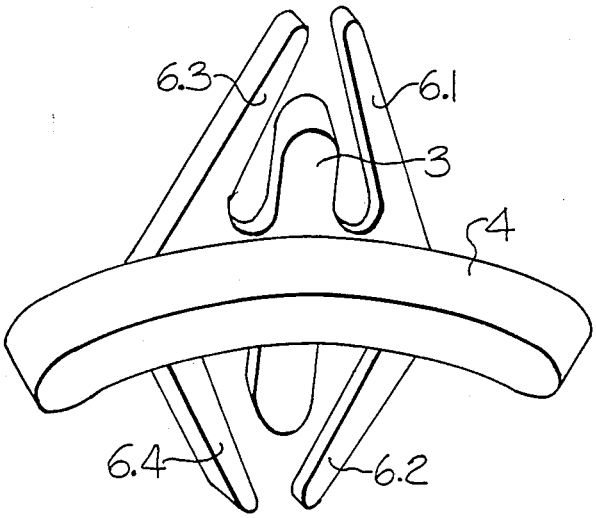
FIG. 4 is a perspective view of the invention.

As can be seen in FIGS. 2 and 3, the traversing yarn guide 1 is supported on the surface of the cross spiraled roll 7 by the underside 13 of the central bar and the guide arms. In the axial or reciprocating direction, the yarn guide is guided by its guide arms 6.1–6.4 in a straight line between the guide rails 9. The guide rails 9 are L-shaped in cross section, and they include two opposing surfaces 10 which extend parallel to each other and along which the two guide arms having parallel outer edges, i.e. arms 6.1 and 6.4 or arms 6.2 and 6.3, are guided in a straight line. Each guide rail also includes a front retaining flange 11, which embraces the guide arms and connecting segments up to the area of the central bar, and thereby prevents the yarn guide from falling forwardly out of the thread groove 8. The contours of the guide arms and their outer edges are shaped so that when the thread pitch reverses at the end of each stroke, the opposite pair of parallel guide arms move into the guiding position. Thus viewing FIG. 3, the guide arms 6.2 and 6.3 and their edges 12.2 and 12.3 are shown in the guiding position, and when the pitch is reversed the guide arms 6.1 and 6.4 with their edges 12.1 and 12.4 will be in the guiding position. The traversing yarn guide is thus adapted to pivot at the end of the traversing stroke about a pivotal axis, which extends substantially along a radial line of the cross spiraled roll 7 and substantially in alignment with the slot 14 of the yarn engaging member 2.

Figure 5:
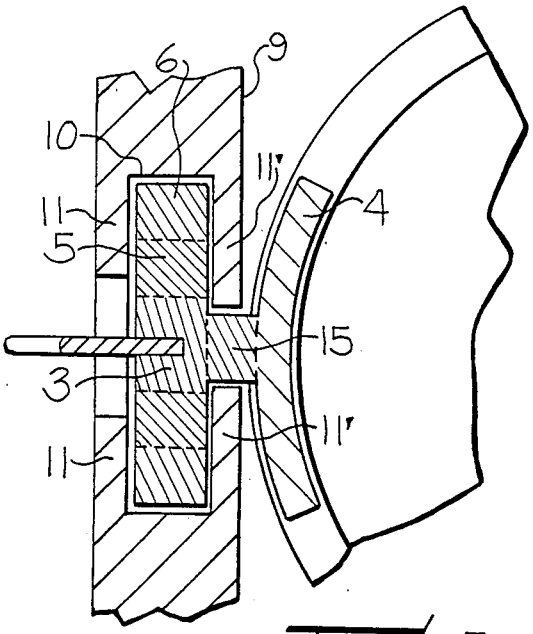
FIG. 5 is a view similar to FIG. 2, and illustrating another embodiment of the invention.

FIG. 5 illustrates a cross sectional view of an alternative embodiment and which is taken along the longitudinal plane of the follower. In this embodiment, a post 15 connects the central bar 3 with the follower 4. The connecting segments 5 extend outwardly from the sides of the central bar and lie approximately in the longitudinal plane of the follower 4, and the ends of the connecting segments mount the inner ends of the adjacent guide arms 6.1–6.4 In this embodiment, the guide rails 9 are U-shaped, and in addition to the opposing surfaces 10, the guide rails are provided with additional flanges 11' on the back side of the arms, so that the arms are embraced on the front and back sides thereof.

Figure 6:
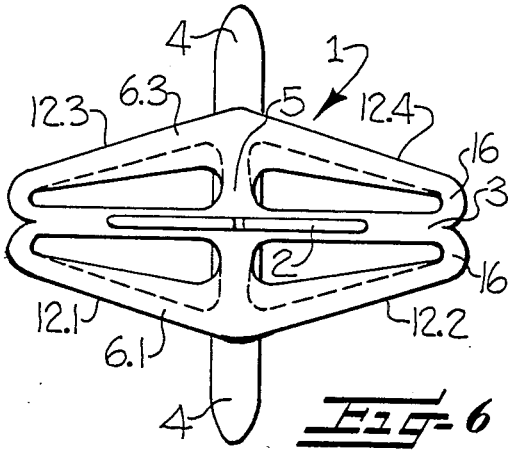
FIGS. 6 and 7 are top plan views of two additional embodiments of the present invention.
Figure 7:
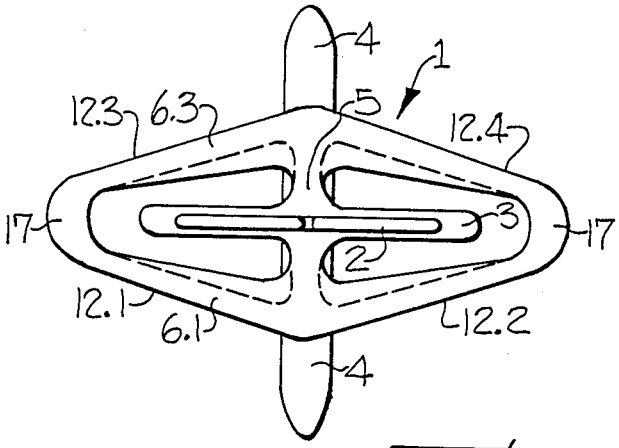

The traversing yarn guides of FIG. 6 and 7 are similar to the previously described embodiments, and as a common feature these embodiments include a yarn engaging member 2 which is mounted on the front side of the guide 1 and which projects beyond the guide rail 9. The yarn is guided in the slot 14 of the yarn engaging member, which is inserted into a slot on the central bar 3. Otherwise, the traversing yarn guide 1 consists of a unitary piece of molded plastic or the like. As in the prior embodiments, the follower 4 defines a longitudinal plane 18 and is curved so that it is adapted to the radius of curvature of the thread groove 8 in the cross spiraled roll 7. Further, the follower 4 also conforms widthwise to the thread groove 8. Both a central bar 3 and the guide arms 6.1–6.4 are attached to the upper side of the follower, and the guide arms have outer guide edges 12.1–12.4 which define a generally diamond shape in plan view. Connecting segments 5 connect the guide arms with the central bar 3 along the longitudinal plane, and the outer ends of the guide arms 6 are adapted for a resilient and dampened movement by reason of the resilient properties of the material of which they are formed.

In the embodiment of FIG. 6, the outer ends of the guide arms are connected to each other and to the ends of the central bar 3 by integral joining segments 16. The joining segments 16 are also flexible and resilient, and this permits the guide arms to have a particularly low elasticity constant, since the guide arms obtain their strength by reason of their being supported by the central bar 3. On the other hand, the total flexibility is only reduced a small amount, since the central bar and also the adjacent guide arms are resiliently designed. This embodiment is desirable in preventing failures which occur from the repeated stresses in the area at which the guide arms are attached to the connecting segments.

In the embodiment of FIG. 7, integral joining segments 17 connect the outer ends of the guide arms with each other, and each individual guide arm is particularly flexible with a low elasticity constant. The strength is improved since each guide arm is supported by the adjacent guide arm, and here again, the joining segments 17 may be made particularly soft.

Figure 8:
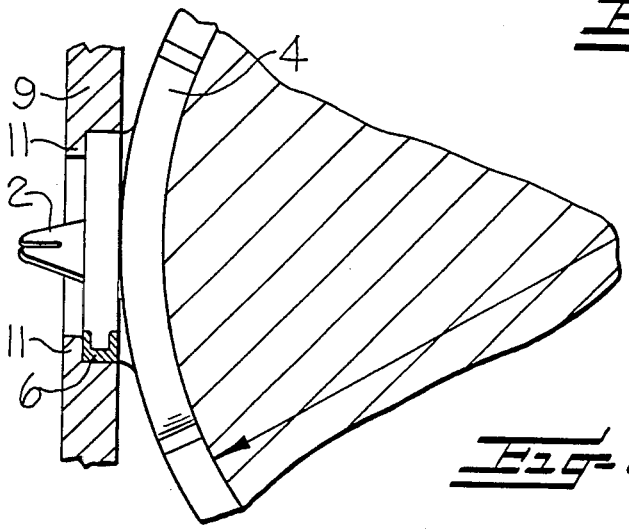
FIG. 8 is a partly sectioned view which is similar to FIG. 2 and which illustrates the embodiments of FIGS. 6 and 7.

FIG. 8 illustrates the embodiment of FIG. 7, with one of the arms shown in cross section. As will be seen, a portion of the under surface, i.e. the surface facing the drive roll 7, is substantially flat, so that this area can slide on the cross spiraled roll and support the traversing yarn guide in the rearward direction. As can also be seen in FIG. 8, the guide arms 6.1–6.4 have a U-shaped outline in cross section, which facilitates the resilience and flexibility of the arms, i.e. a low elasticity constant, and in addition the outline provides adequate strength for resisting the alternating stresses.

To provide an idea of relative size, it should be noted that the drawings herein show the yarn guide substantially enlarged from its actual size, with the enlargement being approximately 1:3.

In the drawings and specification, there has been set forth a preferred embodiment of the invention, and although specific terms are employed, they are used in a generic and descriptive sense only and not for purposes of limitation.

That which I claimed is:

1. A traversing yarn guide adapted for reciprocating an advancing yarn or the like to form a wound package on a yarn winding machine, and comprising:

a body member comprising an elongate follower defining a longitudinal plane, and first and second arms mounted on one side of said follower, and with said arms extending laterally outwardly in opposite directions from said longitudinal plane and being in substantial lateral alignment, and with said arms having relatively straight outer edges which define a somewhat V-shaped outline in plan view and have an obtuse angle therebetween, said arms being composed of a relatively resilient material and such that the arms are relatively flexible, and a yarn engaging member mounted to said body member and including a portion which extends beyond the side of said arms opposite said follower.

2. The traversing yarn guide as defined in claim 1 wherein said body member is composed of an integral piece of plastic material.

3. The traversing yarn guide as defined in claim 2 wherein said yarn engaging member comprises a generally flat plate which is disposed in a laterally directed plane which is substantially perpendicular to said longitudinal plane, and with said flat plate being composed of a wear resistant ceramic material.

4. A traversing yarn guide adapted for reciprocating an advancing yarn or the like to form a wound package on a yarn winding machine, and comprising a body member comprising an elongate follower defining a longitudinal plane, and two pairs of arms mounted on one side of said follower, with each pair including first and second arms which extend laterally outwardly in opposite directions from said longitudinal plane and which are in substantial lateral alignment, and with said arms having outer edges which collectively define a generally diamond shaped outline in plan view, and with said arms being composed of a relatively resilient material so that said arms are relatively flexible, and a yarn engaging member mounted to said body member and including a portion which extends beyond the side of said arms opposite said follower.

5. The traversing yarn guide as defined in claim 4 wherein said body member further comprises a central bar extending laterally between said pairs of arms and generally perpendicular to said longitudinal plane.

6. The traversing yarn guide as defined in claim 5 wherein said yarn engaging member comprises a plate which is mounted to said central bar and which extends in a plane generally perpendicular to said longitudinal plane.

7. The traversing yarn guide as defined in claim 6 wherein said yarn engaging member has a generally triangular outline, and includes a base edge mounted to said central bar and an opposite corner having a yarn receiving slot therein.

8. The traversing yarn guide as defined in claim 4 wherein said body member is composed of an integral piece of plastic, and said yarn engaging member is composed of a separate wear resistant material.

9. The traversing yarn guide as defined in claim 4 wherein each of said arms defines an outer end, and wherein the outer ends of said arms on the same side of said longitudinal plane are connected to each other.

10. The traversing yarn guide as defined in claim 9 wherein said central bar has an end on each side of said longitudinal plane, and each end of said bar is integrally connected to each of the ends of the associated arms.

11. The traversing yarn guide as defined in claim 4 wherein said body member further includes a central bar extending laterally between said pairs of arms and generally perpendicular to said longitudinal plane, and a connecting segment extending longitudinally along said longitudinal plane and between said central bar and each of said pairs of arms, and such that said connecting segments serve to join said pairs of arms to the remainder of said body member.

12. The traversing yarn guide as defined in claim 11 wherein said body member further includes a post positioned between said follower and said central bar.

* * * * *